US005773090A

United States Patent [19]

Büttner et al.

[11] Patent Number: 5,773,090

[45] Date of Patent: Jun. 30, 1998

[54] PROCESS FOR COATING PHOSPHATED METAL SUBSTRATES

[75] Inventors: Gabriele Büttner, Ratingen; Matthias Kimpel, Schwelm; Klausjörg Klein, Wuppertal, all of Germany

[73] Assignee: Herberts Gellschaft mit Beschrankter Haftung, Wuppertal, Germany

[21] Appl. No.: 737,945

[22] PCT Filed: May 23, 1995

[86] PCT No.: PCT/EP95/01957

§ 371 Date: Feb. 26, 1997

§ 102(e) Date: Feb. 26, 1997

[87] PCT Pub. No.: WO95/33083

PCT Pub. Date: Dec. 7, 1995

[30] Foreign Application Priority Data

May 27, 1994 [DE] Germany ..... 44 18 491.3

[51] Int. Cl.[6] ..... B05D 3/00; C25D 5/34; C25D 9/02; C23C 8/10

[52] U.S. Cl. ..... 427/327; 427/330; 204/499; 205/210; 205/317; 205/318; 148/286; 148/287

[58] Field of Search ..... 204/499; 205/210, 205/213, 217, 317, 318, 320, 321, 323; 427/405, 327, 330; 148/286, 287

[56] References Cited

U.S. PATENT DOCUMENTS

| | | | |
|---|---|---|---|
| 4,828,615 | 5/1989 | Cape | 106/14.13 |
| 5,061,315 | 10/1991 | Collier et al. | 106/14.05 |
| 5,385,655 | 1/1995 | Brent et al. | 148/257 |

FOREIGN PATENT DOCUMENTS

| | | |
|---|---|---|
| A0127572 | 12/1984 | European Pat. Off. . |
| A0149720 | 7/1985 | European Pat. Off. . |
| A0492713 | 7/1992 | European Pat. Off. . |
| 0 469 497 | 5/1994 | European Pat. Off. . |
| A2232615 | 1/1975 | France . |
| 2334342 | 7/1973 | Germany . |
| A2334342 | 1/1974 | Germany . |
| 58-130282 | 8/1983 | Japan . |
| 914652 | 3/1982 | U.S.S.R. . |

OTHER PUBLICATIONS

58–130282, "Pretreatment of Metal for Coating", Shin Nippon Seitetsu K.K., C23C22/83, abst. Aug. 3,1983.

153793e, "Laboratory Studies of a New Pretreatment Method", p. 275, Oct. 1988, No. 18, Columbus, OH (abst).

Glasurit–Handbuch, 1984, Translation of the yellow marked passages on p. 456. No month available.

Patent Abstracts of Japan 007 (242), Oct. 27, 1983 & JP, A,130282 (Shin Nippon Seitetsu KK).

Chemical Abstracts, 109 (18) 153793e (Oct. 31, 1988) Ledheiser, "Laboratory Studies of a New Pretreatment Method".

Chemical Abstracts, 97 (26) 220959n (Dec. 27, 1982) Belyi, "Additional Treatment of porous phosphate coatings"& SU–A–914, 652.

Chemical Abstracts 107 (14) 135294x (Oct. 5, 1987) & JP–A–62 032113 (Shikoku Chem. Corp.).

*Primary Examiner*—Kathryn L. Gorgos
*Assistant Examiner*—Edna Wong
*Attorney, Agent, or Firm*—Pillsbury Madison & Sutro LLP

[57] ABSTRACT

A process for coating phosphated metal substrates with one or more organic coatings, in which after phosphating and before application of a first organic coating, the phosphated metal substrates are treated with an aqueous solution which contains 5 to 10000 ppm of dissolved titanium, vanadium, molybdenum, silver, tin, antimony and/or one or more elements of atomic numbers 57 to 83 in the form of inorganic and/or organic compounds, wherein the phosphated metal substrates are additionally connected as a cathode during the entire treatment or for part of the duration of the treatment.

18 Claims, No Drawings

PROCESS FOR COATING PHOSPHATED METAL SUBSTRATES

This is a national stage application of PCT/EP95/01957 filed May 23, 1995.

1. Field of the Invention

This invention relates to a process for coating phosphated metal substrates with organic coatings, in particular electrocoated lacquer coatings.

2. Description of the Related Art

Metallic substrates, for example made from aluminium, but in particular from galvanised or ungalvanised steel, are pretreated for lacquer coating, in particular for an electrophoretically applied lacquer coating, if good anti-corrosion properties are desired and good substrate adhesion of the lacquer layer formed by electrophoretic deposition is to be achieved in a pretreatment process comprising phosphating and a passivating rinsing. The electrocoated lacquer coating is then applied onto this surface and stoved.

It has, for example, become standard practice in automotive original lacquer coating for the cleaned bare bodywork made from galvanised or ungalvanised steel first to be phosphated and then post-treated with a passivating rinsing before a so-called cathodic electrocoating is applied by cathodic deposition as a priming layer (c.f. *Glasurit-Handbuch der Lacke und Farben*, pages 454 et seq., 11th edition, 1984, Curt R. Vincentz Verlag, Hannover). The passivation stage is a necessary part of this process.

In recent years, this basic process which has hitherto been performed in this manner has undergone constant improvement with regard to the composition of the phosphating and passivating materials and of the cathodic electrocoating material. For example, phosphating and passivating materials have been further developed both with regard to their technical characteristics and with regard to their environmental properties, as described by Horst Gehmecker in JOT, issue 5, 1992, pages 42 to 46.

Phosphating variants which have become known are, for example, iron phosphating, zinc phosphating, low-zinc phosphating, tricationic phosphating, manganese-doped phosphating, nickel-free phosphating and nitrite-free phosphating, as is demonstrated by the comprehensive patent literature. Phosphating solutions containing toxic nickel ions have proved particularly technically advantageous. Commercial phosphating products are sold, for example, by Henkel under the names Granodine®, for example Granodine 950 as a tricationic system, Granodine 1990 as a nitrite-free tricationic system or Granodine 2700 as a nickel-free tricationic system.

The search for alternatives which are less questionable on environmental and health grounds to the original and still widely used passivating solutions containing chromate has met with success, as is substantiated by the patent literature. Examples of such alternatives are passivating solutions based on zirconium fluoride or organic compounds. Henkel, for example, thus sells passivating products under the trade name Deoxylyte®, for example, Deoxylyte 41 as a chromate system, Deoxylyte 54 NC as a zirconium fluoride system or Deoxylyte 80 as an organically-based system. Such passivating solutions are distinguished by a complicated composition.

*Polym. Mater. Sci. Eng.*, volume 58, 1988 (pages 176 to 177) describes a process for post-treating phosphate layers before application of an organic coating with an aqueous solution containing tin ions. U.S. Pat. No. 4,828,615 describes the treatment of phosphated surfaces, before application of coating compositions, with an aqueous solution containing pentavalent vanadium compounds. DE-A-23 24 342 relates to an aqueous rinsing agent containing rare earth metals with which inter alia phosphated surfaces are treated before application of a coating of paint. JP-A-58 130 282 describes the treatment of phosphated surfaces with aqueous Fe, Zn, Ni, Mo, Co, W, Mg, Mn or Si solutions before the surfaces receive a coating.

SUMMARY OF THE INVENTION

An object of the present invention is to provide a coating process for phosphated metal substrates which increases corrosion protection beyond previously achieved levels. It should preferably be possible to perform the coating process with post-treatment materials which are of a simple composition and are unquestionable on environmental and health grounds. It should also allow an elevated degree of corrosion protection to be achieved if, on environmental grounds, the preceding phosphating stage is based on a concept which results in only moderate corrosion protection. In particular, it should be possible to perform the coating process without chromium, nickel and nitrite.

It has been found that this object may be achieved by the use provided by the invention of aqueous solutions containing dissolved titanium, vanadium, molybdenum, silver, tin, antimony and/or one or more elements of atomic numbers 57 to 83 in the form of inorganic and/or organic compounds for the treatment of phosphated metal substrates.

DESCRIPTION OF THE PREFERRED EMBODIMENTS

The present invention also provides a process for coating phosphated metal substrates with one or more organic coatings, which process is characterised in that, after phosphating and before application of a first organic coating, the phosphated metal substrates are treated with an aqueous solution which contains 5 to 10000 ppm of dissolved titanium, vanadium, molybdenum, silver, tin, antimony and/or one or more elements of atomic numbers 57 to 83 in the form of inorganic and/or organic compounds, wherein the phosphated metal substrates are additionally connected as a cathode in a direct current circuit during the entire treatment or part of the treatment.

Metal substrates which may be used are conventional metal components as are familiar, for example, in the automotive industry. Examples are components made from aluminium, magnesium or the alloys thereof, iron and in particular steel, for example ungalvanised or galvanised with pure zinc, zinc/nickel alloy or zinc/iron alloy. The various substrates may be present within a single workpiece (composite structure).

The metallic substrates are phosphated in the conventional manner, i.e. using per se known phosphating solutions. Those solutions described by Horst Gehmecker in JOT, issue 5, 1992, pages 42 to 46 may, for example, be used. These are, for example, phosphating materials containing zinc, manganese, iron and/or nickel. In the prior art, those phosphating solutions containing nickel ions have proved particularly advantageous in industrial practice with regard to producing an elevated level of corrosion protection. However, for the purposes of the invention, it has been found that the use of toxic nickel in phosphating solutions may be avoided as it brings about no advantages extending beyond the use according to the invention of aqueous solutions containing titanium, vanadium, molybdenum, silver, tin, antimony and/or elements of atomic numbers 57 to 83. Thus, when the process according to the invention is used, it is possible to perform the preceding phosphating treatment with less effective, but also less toxic phosphating solutions. The phosphating layers may be applied by spraying or dipping. This results in the deposition of a thin layer of phosphate crystals onto the surface of the metal substrate from the solutions. This layer should be as dense and finely grained as possible. After phosphating, the metal substrate is rinsed and optionally dried before it is treated according to the invention, prior to application of the organic coating, with an aqueous solution containing 5 to 10000 ppm of dissolved titanium, vanadium, molybdenum, silver, tin, antimony and/or elements of atomic numbers 57 to 83 in the form of inorganic and/or organic compounds.

Treatment with the aqueous solution may, for example, be performed using a dipping process with immersion lasting, for example, between 1 and 120 seconds. In the case of metal substrates of a complicated shape, such as for example automotive bodywork, dipping is preferred.

Dipping is particularly preferably performed in such a manner that the aqueous solutions used are those containing 5 to 10000 ppm of dissolved titanium, vanadium, molybdenum, silver, tin, antimony and/or elements of atomic numbers 57 to 83 in the form of inorganic and/or organic compounds, wherein the phosphated metal substrate is additionally connected during the treatment as a cathode in a direct current circuit. The anode may, for example, be the treatment tank, as well as a counter electrode. This method additionally results in the removal of disruptive anions from the phosphate layer. A direct voltage in the range from 3 to 100 V, preferably of 5 to 50 V, is preferably used, wherein current densities of 0.1 to 10 $A/m^2$ are used, it being possible for the current to flow during the entire duration of dipping or only during part of the duration of dipping. Current strength may here be held constant while the current flows or current strength is varied.

Aqueous solutions which may be used in the process according to the invention are those containing 5 to 10000 ppm, preferably above 10 and below 6000 ppm, of dissolved titanium, vanadium, molybdenum, silver, tin, antimony and/or elements of atomic numbers 57 to 83 in the form of inorganic and/or organic compounds, calculated as the element. The solutions preferably contain titanium, vanadium, molybdenum, silver and/or elements of atomic numbers 57 to 83 with the exception of mercury, thallium and lead. The elements of atomic numbers 57 to 83 are particularly preferably present with the exception of mercury, thallium and lead, wherein bismuth is most preferred. The aqueous solutions may contain from 5 to 10000 ppm, preferably between 10 and 6000 ppm of two or more of the above-stated elements as a mixture or preferably only one of these elements in dissolved form.

The inorganic and/or organic compounds of the above-stated elements are readily soluble in water or they are sufficiently water soluble to be usable as a source to maintain a concentration of 5 to 10000 ppm of the above-stated elements in the aqueous solutions. In this case, the compounds used in the aqueous solutions are present as a finely divided colloidal solution or dispersion and act as a depot of the corresponding elements.

Suitable inorganic or organic compounds are inorganic or organic complexes of titanium, vanadium, molybdenum, silver, tin, antimony and/or elements of atomic numbers 57 to 83. Acetylacetone may be mentioned as an example of a chelating ligand. Preferred inorganic or organic compounds are, however, the corresponding salts of inorganic or, preferably, organic acids. Examples of salts of inorganic acids are chlorides, sulphates and nitrates. Examples of organic acids which may be used are, for example, mono- or polycarboxylic acids, such as for example aromatic, araliphatic and aliphatic mono- and dicarboxylic acids. Monocarboxylic acid salts are preferred, such as for example benzoates, formates, acetates, propionates, octoates, neodecanoates. The salts of hydroxycarboxylic acids, in particular of aliphatic hydroxycarboxylic acids, have proved particularly suitable. Examples of such salts are salicylates, 4-hydroxybenzoates, lactates, dimethylol-propionates.

For the purposes of the present invention, aqueous media containing 5 to 10000 ppm, preferably between 10 and 6000 ppm, of dissolved bismuth are most highly preferred. Bismuth is furthermore preferably used in the form of a mono- or polycarboxylic acid salt. Examples of suitable organic carboxylic acids, from which bismuth salts usable in the process according to the invention are derived, are aromatic, araliphatic and aliphatic mono- or dicarboxylic acids. Preferred bismuth salts are those of organic monocarboxylic acids, in particular those having more than two C atoms, such as in particular bismuth benzoate, propionate, octoate, neodecanoate. Bismuth salts of hydroxycarboxylic acids are particularly preferred. Examples are bismuth salicylate, 4-hydroxybenzoate, lactate, dimethylolpropionate.

Aqueous solutions usable in the process according to the invention may also contain conventional auxiliary substances, such as for example surfactants.

As the phosphated metal substrates are treated with the aqueous solution, the content of the corresponding element is depleted as a corresponding quantity thereof is incorporated onto the surface of the phosphated metal substrate. This does not involve galvanic deposition of a continuous coating of the corresponding element onto the phosphate layer, but the process according to the invention is preferably performed in such a manner that the element or elements are deposited onto the surface of the phosphated metal substrate in a total quantity of 5 to 100 $mg/m^2$. As a result, the phosphate layer is doped with the element or elements. EDX (energy-dispersive X-ray analysis) may, for example, preferably be used to detect such small quantities of the corresponding elements.

Preferably, the composition of the aqueous solution is continuously monitored analytically, for example by using appropriate ion-selective electrodes. The solution must be replenished with the element, for example by adding an appropriate aqueous concentrate, in line with the measured consumption of the element in the aqueous solution. If salt solutions of the appropriate elements are used, the counter-ion accumulates as the free acid in line with consumption of the element. However, entrainment as the substrates are removed from the solution ensures that a sufficient quantity of the accumulating free acid is removed from the system and an equilibrium is established. This entrainment effect is particularly pronounced when the phosphated metal substrates are three-dimensional articles which thus remove liquid with them. The dipping bath containing the aqueous solution may, however, also be connected to an electrodialysis circuit which is used to remove the accumulating free acid from the dipping bath.

Once the phosphated metal substrates have been treated with the aqueous solution, the substrates may, if desired, be rinsed, for example with deionised water, and dried, before being provided according to the invention with an organic coating. The organic coatings may be applied from aqueous or non-aqueous coating compositions, preferably stoving coating compositions, for example by spraying, dipping or roller coating. The organic coatings are preferably applied by electrocoating, particularly preferably by cataphoretic electrocoating.

Electrocoating lacquers which may be used in the process according to the invention are per se known anodically depositable electrocoating lacquers or preferably cathodically depositable electrocoating lacquers. They are subject to no restrictions. They may contain conventional additives and catalysts.

Examples of electrocoating lacquers which are usable in the process according to the invention are aqueous coating compositions having a solids content of, for example, 10 to 20 wt. %. The solids content consists of conventional binders, bearing substituents which are ionic or convertible into ionic groups together with groups capable of chemical crosslinking, optionally together with pigments and/or extenders and further additives. The ionic groups may be anionic groups or groups convertible into anionic groups, for example COOH groups, or basic cationic groups or groups convertible into cationic groups, for example amino, ammonium, for example quaternary ammonium, phosphonium and/or sulphonium groups. Binders having basic groups are preferred. Basic groups containing nitrogen are particularly preferred. These groups may be present in quaternised form or they are converted in a manner familiar to the person skilled in the art into ionic groups using a conventional neutralising agent, for example an organic monocarboxylic acid, such as for example lactic acid, formic acid, acetic acid.

Examples of anodically depositable electrocoating lacquer binders and lacquers containing anionic groups are described in DE-A-28 24 418. These are, for example, binders based on polyesters, epoxy resin esters, (meth) acrylic copolymers, maleate oils or polybutadiene oils having a weight average molecular weight of, for example, 300 to 10000 and an acid value of 35 to 300 mg of KOH/g. The binders bear —COOH, —$SO_3H$ and/or —$PO_3H_2$ groups. The resins may be converted into the aqueous phase by neutralising at least a proportion of the acidic groups. The lacquers may also contain conventional crosslinking agents, for example triazine resins, crosslinking agents containing transesterifiable and/or transamidatable groups or blocked polyisocyanates.

Cathodic electrocoating lacquers based on cationic or basic binders are, however, preferred. Such basic resins are, for example, resins containing primary, secondary and/or tertiary amino groups having amine values of, for example, around 20 to 250 mg of KOH/g. The weight average molecular weight (Mw) of the base resins is preferably around 300 to 10000. Examples of such base resins are amino(meth)acrylic copolymer resins, aminoepoxy resins, aminoepoxy resins having terminal double bonds, aminoepoxy resins having primary OH groups, aminopolyurethane resins, polybutadiene resins containing amino groups or modified epoxy resin/carbon dioxide/amine reaction products. These base resins may be self-crosslinking or they are used mixed with known crosslinking agents. Examples of such crosslinking agents are amino resins, blocked polyisocyanates, crosslinking agents having terminal double bonds, polyepoxy compounds or crosslinking agents containing transesterifiable and/or transamidatable groups.

Examples of base resins and crosslinking agents used in cathodic electrocoating lacquer baths which may be used according to the invention are described in EP-A-0 082 291, EP-A-0 234 395, EP-A-0 209 857, EP-A-0 227 975, EP-A-0 178 531, EP-A-0 333 327, EP-A-0 310 971, EP-A-0 456 270, U.S. Pat. No. 3,922,253, EP-A-0 261 385, EP-A-0 245 786, DE-33 24 211, EP-A-0 414 199, EP-A-0 476 514. These resins may be used alone or as a mixture.

In addition to the base resins and any optionally present crosslinking agent, the electrocoating lacquer may contain pigments, extenders and/or conventional lacquer additives. Pigments which may be considered are conventional inorganic and/or organic pigments. Examples are carbon black, titanium dioxide, iron oxide, kaolin, talcum or silicon dioxide. It is also possible to use conventional anti-corrosion pigments. Examples of these are zinc phosphate, lead silicate or organic corrosion inhibitors. The nature and quantity of the pigments depends upon the intended purpose of the coating compositions. If clear coatings are to be obtained, no pigments, or only transparent pigments, such as for example micronised titanium dioxide or silicon dioxide, are used. If opaque coatings are to be applied, the electrocoating lacquer bath preferably contains colouring pigments.

The pigments may be dispersed as pigment pastes, for example using known paste resins. Such resins are familiar to the person skilled in the art. Examples of paste resins usable in cathodic electrocoating lacquer baths are described in EP-A-0 183 025 and EP-A-0 469 497.

Possible additives are conventional additives for electrocoating lacquer compositions. Examples of these are wetting agents, neutralising agents, levelling agents, catalysts, antifoaming agents together with conventional solvents used in coating compositions.

After coating with electrocoating lacquer, the coating is crosslinked by stoving. If the electrocoated lacquer is a primer, subsequent layers may be applied.

Using the process according to the invention, a lacquer coating is obtained which has excellent adhesion to the substrate and outstanding anti-corrosion properties which exceed those achieved with hitherto known coatings involving phosphating, conventional passivation and organic coating. The process according to the invention avoids the use of nickel, chromium and nitrite. In the process according to the invention, it is possible for the phosphating agent to contain no metal compounds hazardous to the environment and to health. The process according to the invention allows the phosphate layer to be post-treated using aqueous solutions of a simple composition.

EXAMPLE 1

(Production of an organic bismuth salt)

2154 parts of deionised water and 938 parts (7 mol) of dimethylolpropionic acid are introduced into a vessel and heated to 70° C. 466 parts (1 mol) of conventional commercial bismuth oxide ($Bi_2O_3$) are stirred in portions. After a further 6 hours' stirring at 70° C., the batch is cooled to approximately 20° C. and left to stand for 12 hours without stirring. Finally, the precipitate is filtered out, washed with a little water and ethanol and dried at a temperature of 40° to 60° C.

EXAMPLE 2

(Production of a cathodic electrocoating lacquer dispersion)

a) 832 parts of the monocarbonate of an epoxy resin based on bisphenol A (commercial product, Epicote 828) are mixed with 830 parts of a conventional commercial polycaprolactone polyol (commercial product, CAPA 205) and 712 parts of diethylene glycol dimethyl ether and reacted at 70° to 140° C. with approximately 0.3% of $BF_3$ etherate until an epoxy value of 0 is reached. 307 parts of a reaction product prepared from 174 parts of tolylene diisocyanate (2 equivalents of NCO) with 137 parts of 2-ethylhexanol with the addition of 0.3% of benzyltrimethylammonium hydroxide (Triton B) having an NCO content of approximately 12.8% are added to the first product of a) (solids content 70%, 2 equivalents of carbonate) at 40° to 80° C. in the presence of 0.3% of Zn acetylacetonate as catalyst. The mixture is reacted until an NCO value of approximately 0 is achieved and the solids content is then adjusted to approximately 70% with diethylene glycol dimethyl ether.

b) 618 parts of a reaction product prepared from 348 parts of tolylene diisocyanate (80% 2,4 isomer; 20% 2,6 isomer) with 274 parts of 2-ethylhexanol with the addition of 0.3% of benzyltrimethylammonium hydroxide as catalyst and having a residual NCO content of 12.8% are slowly added at 60° to 80° C. to 1759 parts of an epoxy resin biscarbonate based on bisphenol A (commercial product, Epicote 1001®) with catalysis by 0.3% of a nonionic emulsifier (Triton B®). The reaction is continued until an NCO value of approximately 0 is reached. The product has a solids content of 70%. 622 parts of the reaction product prepared from 137 parts of 2-ethylhexanol with 174 parts of tolylene diisocyanate with benzyltrimethylammonium hydroxide catalysis (0.3%) (NCO content approximately 12.8%) are added at a temperature of 20° to 40° C. to 860 parts of bishexamethylenetriamine dissolved in 2315 parts of methoxypropanol and reacted until an NCO content of approximately 0 is reached. 4737 parts of reaction product b) and 3246 parts of reaction product a) (each 70% in diethylene glycol dimethyl ether) are then added and reacted at 60° to 90° C. The reaction is terminated at an amine value of approximately 32 mg of KOH/g. The resultant product is vacuum distilled to a solids content of approximately 85%.

The product is neutralised with 30 mmol of formic acid per 100 g of resin and converted into a dispersion having a solids content of 40 wt. % with deionised water.

EXAMPLE 3

(Production of a pigment paste)

15 parts of acetic acid (50%), 30 parts of a conventional commercial wetting agent (50%) and 374 parts of deionised water are added in a high speed stirrer to 223 parts of the paste resin according to EP-A-0 469 497 A1, Example 1 (55%).

To this are added 5 parts of carbon black, 5 parts of pyrogenic silica, 25 parts of dibutyltin oxide powder, 38 parts of lead silicate and 560 parts of titanium dioxide. The solids content is adjusted to approximately 50% with deionised water and the mixture ground in a bead mill. A stable pigment paste is obtained.

EXAMPLE 4

(Production of a cathodic electrocoating lacquer containing lead and tin)

4.5 parts of formic acid (50%) and 1760 parts of deionised water are added to 815.5 parts of the dispersion from Example 2. 420 parts of pigment paste according to Example 3 are thoroughly stirred in.

Production of Multi-Layer Lacquer Coatings

Example 5a (comparative test)

Ungalvanised sheet steel (ST 1405) Bonders 26/60/OC (so-called "bonder" sheet sold for testing purposes by the company Chemetall with tricationic phosphating containing nickel and chromic acid passivation) is coated to a dry film thickness of 20 μm with the cathodic electrocoating lacquer from Example 4 and stoved for 10 minutes at 175° C. (object temperature). A conventional commercial surfacer is then sprayed on to a dry film thickness of 35 μm and stoved for 15 minutes at 165° C. (object temperature). A single layer topcoat lacquer suitable for automotive original lacquer coating is then sprayed on to a dry film thickness of 40 μm and stoved for 30 minutes at 130° C. (object temperature).

Example 5b (comparative test)

Example 5a is repeated, but using Bonder® 2640/W/OC (ST 1405) sheet steel (so-called "bonder" sheet sold for testing purposes by the company Chemetall with nickel-free tricationic phosphating and no passivation).

Example 5c (example according to the invention)

Example 5b is repeated with the difference that, prior to application of the cathodic electrocoating lacquer, the sheet is immersed for 10 seconds at room temperature into an aqueous solution of the bismuth salt from Example 1 having a bismuth content of 1000 ppm and is then rinsed with deionised water and dried. During immersion, the sheet is connected as a cathode at a voltage of 10 V and a current density of 1.5 A/m$^2$.

Corrosion protection is tested to VDA guideline 621–415, duration of test 10 cycles. Under-film corrosion is stated in mm as a range from 5 tests in each case to DIN 53 167. The results obtained are shown in Table 1.

TABLE 1

| Example | Corrosion protection testing |
|---|---|
| 5a Comparative test | 1.2–1.8 mm |
| 5b Comparative test | 3.7–4.5 mm |
| 5c According to the invention | 1.1–1.4 mm |

It can be seen that the under-film corrosion properties of a cathodically electrocoated lacquer coating are retained or even improved using the process according to the invention, even in comparison with a substrate previously phosphated using a phosphating solution containing nickel.

What is claimed is:

1. Process for coating a metal substrate, comprising:

phosphating the metal substrate in a phosphating solution which contains no nickel;

treating the phosphated metal substrate with an aqueous solution after phosphating and before application of a first organic coating;

wherein the treating step is performed with an aqueous solution which contains 5 to 10000 ppm of dissolved bismuth in a form of at least one member selected from the group consisting of inorganic bismuth compounds and organic bismuth compounds, and wherein the bismuth is deposited in a total quantity of 5 to 100 mg/m$^2$; and applying one or more organic coatings.

2. Process according to claim 1, wherein the aqueous solution contains one or more bismuth salts of at least one member selected from the group consisting of organic acids and inorganic acids.

3. Process according to claim 2, wherein the organic acids comprise at least one member selected from the group consisting of mono-carboxylic acids and polycarboxylic acids.

4. Process according to claim 1 wherein the aqueous solution contains bismuth salts of hydroxycarboxylic acids.

5. Process according to claim 1 comprising applying at least one of the organic coatings by stoving.

6. Process according to claim 1, wherein at least one of the organic coatings is an electrocoating lacquer applied by electrocoating.

7. Process for coating a metal substrate, comprising:

phosphating the metal substrate in a phosphating solution which contains no nickel;

treating the phosphated metal substrate with an aqueous solution after phosphating and before application of a first organic coating;

wherein the treating step is performed with an aqueous solution which contains 5 to 10000 ppm of dissolved bismuth in a form of at least one member selected from the group consisting of inorganic bismuth compounds and organic bismuth compounds, and wherein the bismuth is deposited in a total quantity of 5 to 100 $mg/m^2$;

further comprising connecting the phosphated metal substrate as a cathode during at least a part of the treating step; and applying one or more organic coatings.

8. Process according to claim 2, wherein the aqueous solution contains one or more bismuth salts of at least one member selected from the group consisting of organic acids and inorganic acids.

9. Process according to claim 8, wherein the organic acids comprise at least one member selected from the group consisting of monocarboxylic acids and polycarboxylic acids.

10. Process according to claim 2, wherein the aqueous solution contains bismuth salts of hydrocarboxylic acids.

11. Process according to claim 2, comprising applying at least one of the organic coatings by stoving.

12. Process according to claim 2, wherein at least one of the organic coatings is an electrocoating lacquer applied by electrocoating.

13. Process for coating a metal substrate, comprising:

phosphating the metal substrate in a phosphating solution which contains no nickel;

treating the phosphated metal substrate with an aqueous solution after phosphating and before application of a first organic coating;

wherein the treating step is performed with an aqueous solution which contains 5 to 10000 ppm of dissolved bismuth in a form of inorganic bismuth compounds alone or together with organic bismuth compounds, and wherein the bismuth is deposited in a total quantity of 5 to 100 $mg/m^2$; and applying one or more organic coatings.

14. Process according to claim 13, wherein the aqueous solution contains one or more bismuth salts of at least one member selected from the group consisting of organic acids and inorganic acids.

15. Process according to claim 14, wherein the organic acids comprise at least one member selected from the group consisting of monocarboxylic acids and polycarboxylic acids.

16. Process according to claim 13, wherein the aqueous solution contains bismuth salts of hydrocarboxylic acids.

17. Process according to claim 13, comprising applying at least one of the organic coatings by stoving.

18. Process according to claim 13, wherein at least one of the organic coatings is an electrocoating lacquer applied by electrocoating.

* * * * *